US006072380A

United States Patent [19]

Monroe

[11] Patent Number: 6,072,380

[45] Date of Patent: Jun. 6, 2000

[54] BOBBIN-WOUND CURRENT SENSE TRANSFORMER

[75] Inventor: David B. Monroe, New Richmond, Ohio

[73] Assignee: Stanetex Electronics, Cincinnati, Ohio

[21] Appl. No.: 09/270,370

[22] Filed: Mar. 16, 1999

[51] Int. Cl.[7] ..... H01F 27/29; H01F 27/30

[52] U.S. Cl. ..... 336/198; 336/208; 336/192

[58] Field of Search ..... 336/192, 198, 336/200, 208

[56] References Cited

U.S. PATENT DOCUMENTS

| | | | |
|---|---|---|---|
| 4,200,853 | 4/1980 | Jong et al. | 336/192 |
| 4,419,645 | 12/1983 | Lennon | 336/65 |
| 5,181,004 | 1/1993 | Johnson | 336/198 |
| 5,774,028 | 6/1998 | Kim | 333/181 |
| 5,847,518 | 12/1998 | Ishiwaki | 315/276 |

OTHER PUBLICATIONS

Falco, "Current Sensor" Brochures, see enclosed, Oct. 1998.
Coilcraft Brochure, see enclosed, Jun. 1997.
T.J. Assemblies, Inc., Brochures, see enclosed, dated unknown.

*Primary Examiner*—Michael L. Gellner
*Assistant Examiner*—Anh Mai
*Attorney, Agent, or Firm*—William B. Ritchie

[57] ABSTRACT

A bobbin-wound current sense transformer includes a regular bobbin secondary winding that has a central aperture and a U-shaped staple that also functions as a one turn primary winding. This dual function of the U-shaped staple eliminates the need for a separate primary winding and a separate primary terminal. Magnetic coupling for the primary and secondary windings is provided through a core that has a first and a second member. A primary bobbin flange and a secondary bobbin flange with each having a central aperture provides electrical isolation from the primary winding to the secondary winding and the core. The first and second members of the core are connectable through a central aperture to form a magnetic path linking the bobbin secondary winding and the primary winding. The bobbin flanges are arranged along the central aperture to provide electrical isolation from the primary winding to the secondary winding and the core. The primary winding can have a plurality of U-shaped staples instead of one U-shaped primary terminal.

2 Claims, 4 Drawing Sheets

BOBBIN-WOUND CURRENT SENSE TRANSFORMER

FIELD OF THE INVENTION

The present invention relates to the field of current sense transformers and, in particular, to a bobbin-wound current sense transformer that is designed to eliminate connections between a primary winding and primary terminal.

BACKGROUND OF THE INVENTION

Current sense transformers are used to measure current passing through a conductor. Typical applications for current sense transformers are overload sensing, load variation sensing, and electric power metering. The construction of a current sense transformer depends on the desired transformer efficiency, which in turn is dictated by the requirements of the application that uses the current sense transformer.

Current sense transformers that are required to be optimized to work at a very high efficiency use a toroidal winding wherein the secondary winding is wound around a transformer core. These toroidal winding type current sense transformers are expensive to fabricate and therefore not practical for use in applications where transformer efficiency is not critical. Laminated core transformers are less expensive to fabricate than wound core devices, and transformer windings obtained from a simple bobbin machine can be used for these laminated core transformers.

A typical bobbin-wound current sense transformer has a laminated core, a primary winding that has a single turn (or small number of turns) and a secondary winding with a large number of turns wherein the secondary winding is obtained from a simple bobbin machine. The primary and secondary windings are mounted on the core and there are separate primary and secondary terminals connected to the primary and secondary windings respectively. Insulating members separate the primary winding, secondary winding and the core from one another. Typical of this type of unit is a device manufactured by Falco Electronics. This company sells a bobbin-wound current sense transformers with a single turn primary winding and a bobbin type secondary winding. Their unit uses a round single turn primary winding which also serves as a terminal. However, the use of a round wire that passes through an insulating flange is inherently unstable.

A typical current sense transformer during operation has its primary winding connected in series with an alternating current source to be monitored. This current is coupled magnetically by the magnetic core shared by the primary and secondary windings. The current is reduced by the ratio of secondary to primary turns. A resistor is connected across the secondary winding so that the reduced current will flow through the winding and develop a voltage across the resistor. The voltage is dependent upon the value of the resistor connected across the secondary, and the amount of current flowing through the secondary.

Presently, most manufactured bobbin wound current sense transformer apparatus use a separate primary winding and a separate primary terminal which must be connected together. The primary winding is connected to one end of the terminal and the other end of the terminal is connectable to a PCB. The current apparatus requires a separate primary winding and two pins on which one end of each of the pins is used to wrap an end of the wire from the primary winding and the other ends of the pins plug into the PCB. This method/manufacture results in additional expense and complexity. The winding/terminal connection is also a potential source of problems.

SUMMARY OF THE INVENTION

The invention is a bobbin-wound current sense transformer apparatus. In its preferred form, the bobbin-wound current sense transformer includes a two member core, a regular bobbin secondary winding that has a central aperture and a U-shaped staple installed closely positioned adjacent to the core such that the U-shaped staple also functions as a one turn primary winding. This dual function of the U-shaped staple eliminates the need for a primary winding to have a separate primary terminal. Magnetic coupling for the primary and secondary windings is provided through a laminated core. Two bobbin flanges, one each for the primary winding and the secondary winding, are mounted on the core. The bobbin flange for the primary winding has grooves into which the U-shaped staple can be inserted. The bobbin flanges also provide electrical isolation from the primary winding to the secondary winding and the core. The first and second members of the core are connectable to form a magnetic path linking the bobbin secondary winding and the primary winding.

In an alternate embodiment, the primary winding can have a plurality of U-shaped staples instead of one U-shaped staple. The plurality of U-shaped staples are stacked preferably in the same plane. However, each staple could also be in a different plane even though that will degrade performance. Each U-shaped staple has a cross section less than that of the single U-shaped staple used in the one turn primary winding configuration for a current rating that is identical in both embodiments. Thus for similar current ratings as a single U-shaped staple embodiment, a plurality of U-shaped staples occupy less space in a linear direction when stacked one above the other in parallel, resulting in the possibility of a larger secondary winding.

Therefore, it is an aspect of the invention to provide a bobbin-wound current sense transformer with a single U-shaped staple that is installed closely positioned adjacent to the core such that the U-shaped staple also functions as a one turn primary winding.

It is another aspect of the invention to provide a primary winding with a decreased cross section using a plurality of U-shaped staples stacked in parallel thereby allowing for a larger secondary winding.

It is a further aspect of the invention to provide a bobbin-wound current sense transformer that may be easily installed and is simple and easy to construct.

These aspects of the invention are not meant to be exclusive and other features, aspects, and advantages of the present invention will be readily apparent to those of ordinary skill in the art when read in conjunction with the following description, appended claims and accompanying drawings.

DETAILED DESCRIPTION OF THE DRAWINGS

Figure 2:
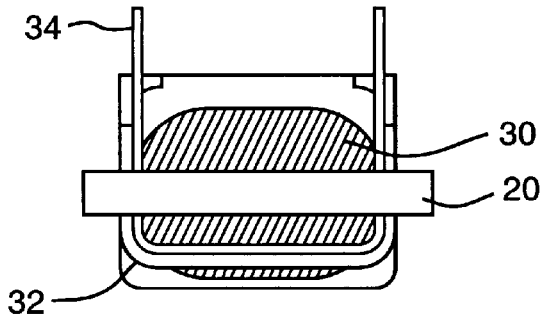
FIG. 2 is a profile view of the primary stage end of the preferred embodiment of the invention.
Figure 1:
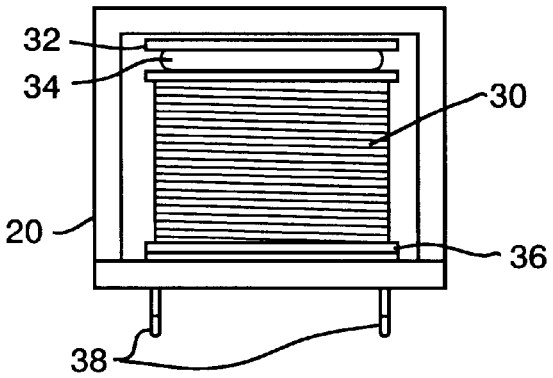
FIG. 1 is a top view of the preferred embodiment of the invention.
Figure 3:
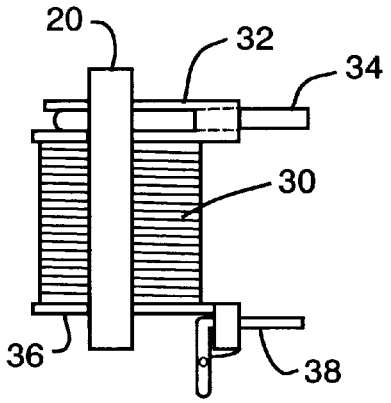
FIG. 3 is a profile view of a side perpendicular to both primary and secondary stages of the preferred embodiment of the invention.
Figure 4:
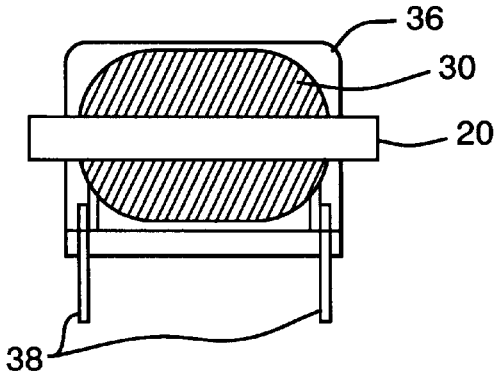
FIG. 4 is a profile view of the secondary stage end of the preferred embodiment of the invention.
Figure 6:
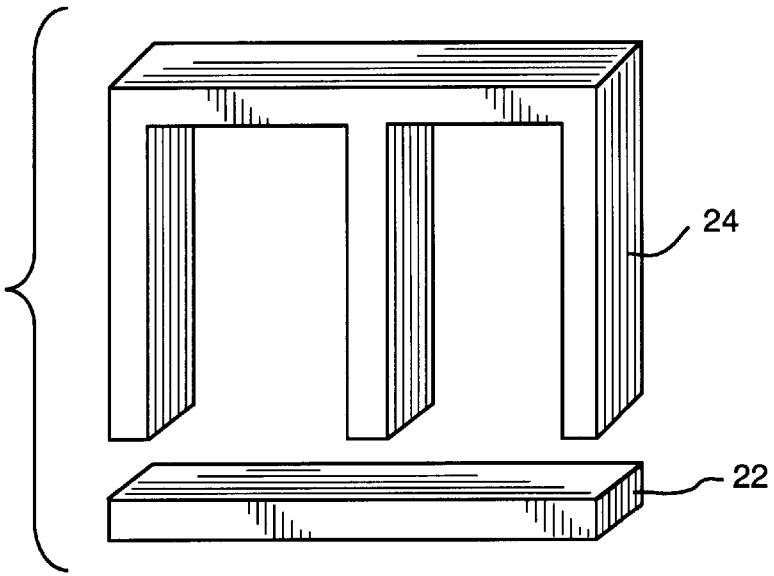
FIG. 6 is an isometric view of an unassembled core used in a preferred embodiment of the invention.
Figure 5:
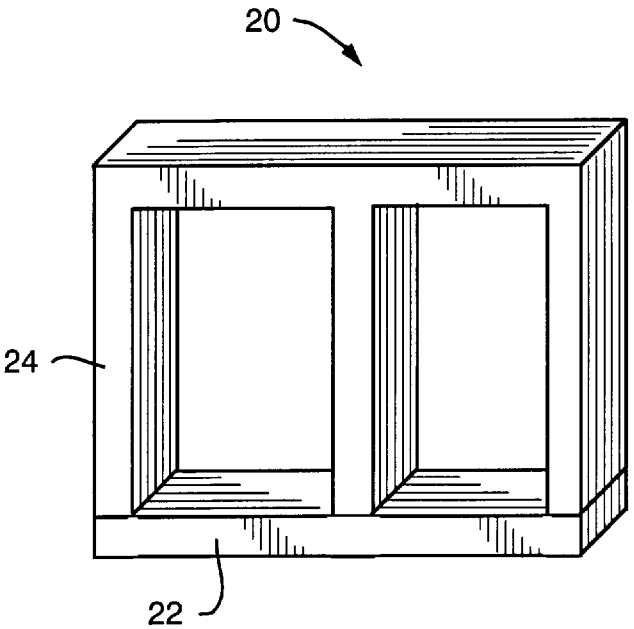
FIG. 5 is an isometric view of a assembled core used in a preferred embodiment of the invention.
Figure 7:
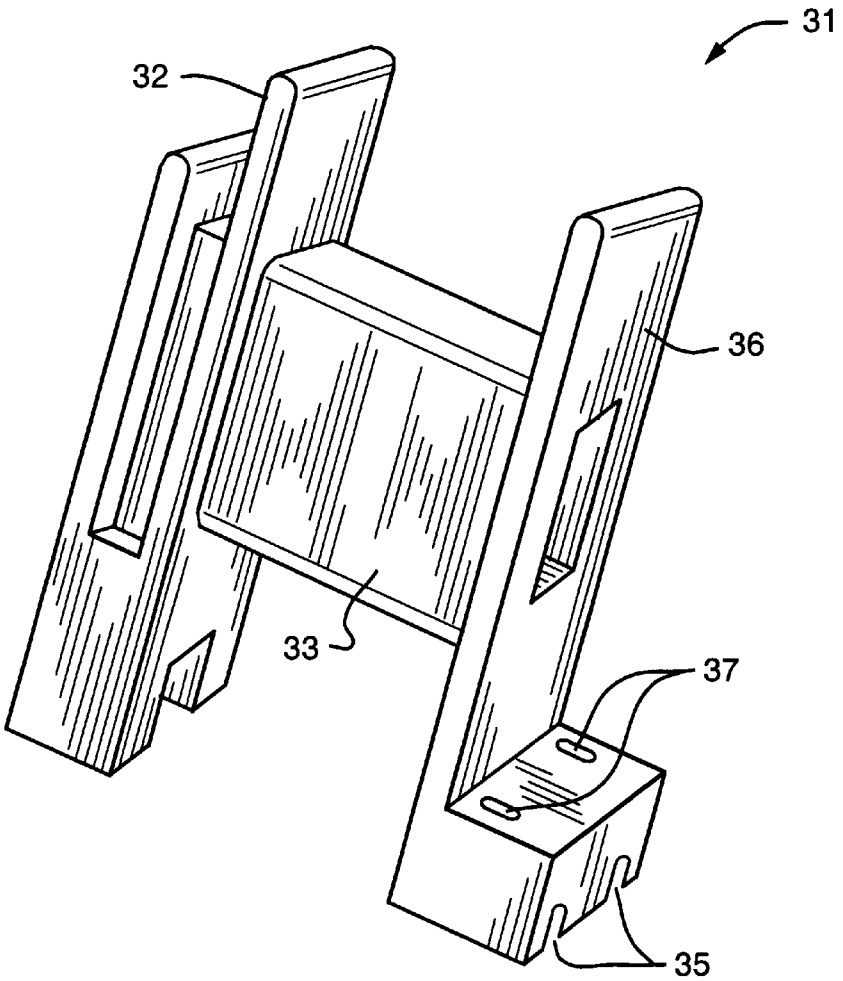
FIG. 7 is an isometric view of a bobbin used in a preferred embodiment of the invention.
Figure 10:
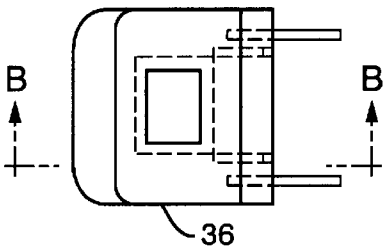
FIG. 10 is a profile view of a secondary bobbin flange of the preferred embodiment of the invention.
Figure 16:
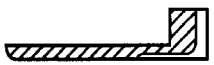
FIG. 16 is a sectional view of a cavity through which a secondary wire is routed to a secondary terminal.
Figure 15:
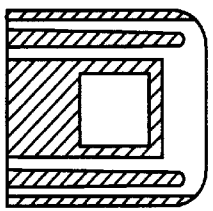
FIG. 15 is a sectional view of a primary bobbin flange showing supports for two U-shaped staples.
Figure 8:
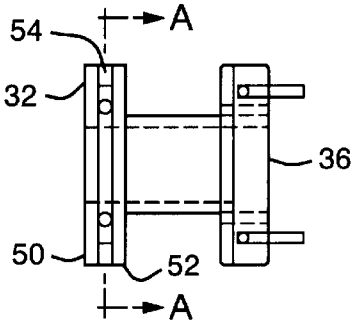
FIG. 8 is a top view of the present invention with the core portion not shown.
Figure 11:
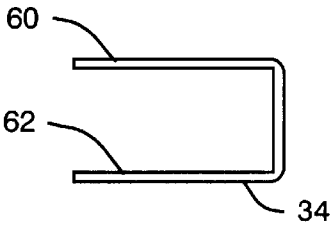
FIG. 11 is a profile view of a U-shaped staple used as a combined primary winding and terminal.
Figure 14:
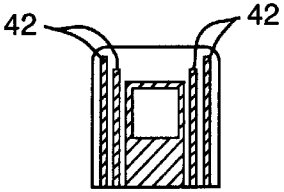
FIG. 14 is a sectional view of a primary bobbin flange showing supports for U-shaped staples.
Figure 9:
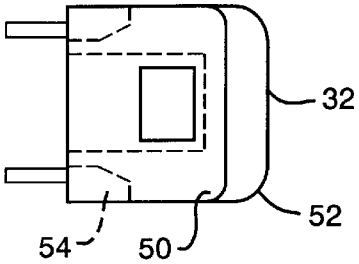
FIG. 9 is a profile view of a primary bobbin flange of the preferred embodiment of the invention.
Figure 12:
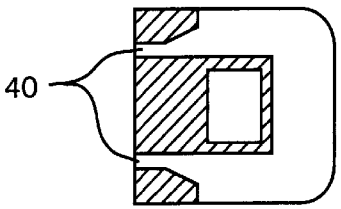
FIG. 12 is a sectional view of a primary bobbin flange showing grooves to receive the U-shaped staple of FIG. 10.
Figure 13:
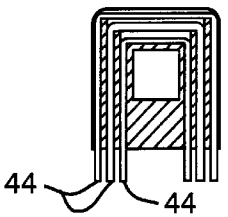
FIG. 13 is a sectional view of a primary bobbin flange showing multiple U-shaped staples.

Referring to FIGS. 1–4 for a top view along with side views of the present invention, FIGS. 5 and 6 for an isometric view of a two-section core portion and FIG. 7 for an isometric view of a bobbin, a complete embodiment of the present invention is shown. The bobbin-wound current sense transformer 10 has a core portion 20, which is made up of two laminated sections; a first section 22 that is a rectangular block and a second section 24 that is E-shaped. The vertical portion of the E-shaped section 24 is a rectangular block identical to the first section 22. The three horizontal extensions of the E-shaped section 24 are also rectangular blocks with the middle horizontal extension equal in dimension to the side horizontal extensions. The central limb of the E-shaped section 24 of the core portion 20 serves as a support for a bobbin 31 having a primary bobbin flange 32, a secondary bobbin flange 36 and a middle portion 33 connecting the primary bobbin flange 32 to the secondary bobbin flange 36. The primary bobbin flange 32, middle portion 33, and secondary bobbin flange 36 provide electrical isolation from the primary winding to the bobbin type secondary-winding 30 and the core 20. A U-shaped staple 34 is fitted into grooves in the primary bobbin flange 32 to form a combined primary winding and primary terminal. The bobbin type secondary winding 30 is wound on middle portion 33 of bobbin 31. The secondary bobbin flange 36 has a pair of cavities 35 through which secondary wires are routed and also has grooves 37 to hold a pair of pins 38 that form a secondary terminal. Ends of the bobbin type secondary winding 30 are wound on the pins to provide electrical connections for the bobbin type secondary windings 30. The primary bobbin flange 32, secondary bobbin flange 36 and the connecting middle portion 33 have a central aperture that fits into the middle horizontal extension of the E-shaped section 24 of the core 20. Assembly of the bobbin-wound current sense transformer 10 involves the steps of fitting the primary bobbin flange 32 with the U-shaped staple 34; winding the bobbin type secondary winding on middle portion 33; inserting a pair of pins 38 into grooves 37 in the secondary bobbin flange 36 and connecting ends of the bobbin type secondary winding 30 to these pins 38; fitting the bobbin 31 into the middle horizontal extension of the E-shaped section 24 of the core 20, and finally fastening of the first section 22 of the core 20 to open ends of the horizontal extensions of the E-shaped section 24 thereby completing the assembly of the bobbin-wound current sense transformer 10. Other transformer cores well known in the art such as interleaved cores can also be used instead of the two-section core described above.

Referring to FIGS. 9–16 for details of the present invention with the core portion not shown. Section A—A of the primary bobbin flange shows U-shaped staple 34 and grooves 40 formed as a result of pushing U-shaped staple 34 into primary bobbin flange 32. The U-shaped staple 34 has cross section, which is preferably rectangular. U-shaped staples with rectangular cross sections hold firmly in grooves 40 in spite of being subjected to heat generated during use of the bobbin-wound current sense transformer. A U-shaped staple 34 with other cross sectional shapes can also be used. Primary bobbin flange 32 has a bottom block 54 and separated raised portions 50 and 52. The separation between the raised potions 50 and 52 is sufficient to accommodate U-shaped staple 34. The U-shaped staple 34 is inserted between raised portions 50 and 52 of the primary bobbin flange 32 and legs 60 and 62 of U-shaped staple 34 are forced through the bottom block 54 of the primary bobbin flange 32.

The primary stage can also be made of a plurality of U-shaped staples 44 instead of using a single U-shaped staple 34. The plurality of U-shaped staples 44 are preferably stacked one above the other in the same plane and kept from touching each other with the use of supports 42 molded into the primary bobbin flange 32. The cross sectional area of each U-shaped staple of the plurality of U-shaped staples 44 decreases as the number of U-shaped staples 44 stacked in parallel increase for the same current rating. Each of the plurality of U-shaped staples 44 can either be connected together and then connected to an external circuit or used individually to form separate external circuits. Section B—B shows a cavity through which a secondary wire is routed to a secondary terminal.

Regular insulation material well known in the art is used for the bobbin flanges. Laminated core is made from material well known in the art for use in laminated cores. The U-shaped staples and secondary pins are made from electrical conductor materials well known in the art for such purposes.

Although the present invention has been described in considerable detail with reference to certain preferred versions thereof, other versions would be readily apparent to those of ordinary skill in the art. Therefore, the spirit and scope of the appended claims should not be limited to the description of the preferred versions contained herein.

What is claimed is:

1. A bobbin-wound current sense transformer apparatus having a core, said transformer apparatus comprising:

a second stage comprising:

a single U-shaped staple having two legs, a rectangular cross section and a current rating, such that said single U-shaped staple is installed closely positioned adjacent to said core to function as a one turn primary winding with an integral primary terminal for said apparatus;

a primary bobbin flange comprising:

a pair of raised portions having a separation; wherein said separation is dimensioned to receive said U-shaped staple;

a bottom block connecting said pair of raised portions; wherein said legs can be pushed into said bottom block, such that when said U-shaped staple in said primary bobbin flange, said primary stage of said apparatus is provided;

a primary stage comprising:

a plurality of U-shaped staples stacked in the same plane and positioned with said primary bobbin flange, such that said plurality of U-shaped staples are separated to prevent each of said U-shaped staples from contacting an adjacent U-shaped staple.

2. The apparatus as claimed in claim 1, wherein each of said plurality of U-shaped staples has a cross section smaller than said cross section of said single U-shaped staple, such that a combined current rating of said plurality of U-shaped staples is substantially equivalent to said current rating of said single U-shaped staple.

* * * * *